US005951068A

United States Patent [19]

Strong et al.

[11] Patent Number: 5,951,068

[45] Date of Patent: Sep. 14, 1999

[54] LOCK FOR SLIDING DOOR

[75] Inventors: Nathan Paul Strong; David Nicholas Allum, both of Auckland, New Zealand

[73] Assignee: Interlock Group Limited, New Zealand

[21] Appl. No.: 08/894,628

[22] PCT Filed: Feb. 14, 1996

[86] PCT No.: PCT/NZ96/00009

§ 371 Date: Aug. 7, 1997

§ 102(e) Date: Aug. 7, 1997

[87] PCT Pub. No.: WO96/25576

PCT Pub. Date: Aug. 22, 1996

[30] Foreign Application Priority Data

Feb. 17, 1995 [NZ] New Zealand ..... 270516

[51] Int. Cl.[6] ..... E05C 1/06

[52] U.S. Cl. ..... 292/39; 292/29; 292/51; 292/112; 292/DIG. 72; 292/DIG. 46

[58] Field of Search ..... 292/39, 24, 63, 292/196, 66, DIG. 46, 112, 111, 110, 199, 6, 11, 22, 51, 160, 172, 332, 359, 25, 29, 27, DIG. 72; 70/95, 160

[56] References Cited

U.S. PATENT DOCUMENTS

| | | | |
|---|---|---|---|
| 1,038,624 | 1/1912 | Messick | 292/63 |
| 1,070,365 | 8/1913 | Voight | 292/47 |
| 1,667,600 | 4/1928 | Martinek . | |
| 2,253,495 | 8/1941 | Cordrey et al. | 70/447 |
| 2,540,686 | 2/1951 | Milburn | 292/124 |
| 3,899,201 | 8/1975 | Paioletti | 292/25 |
| 3,904,229 | 9/1975 | Waldo | 292/29 |
| 4,643,005 | 2/1987 | Logas | 70/95 |
| 5,526,659 | 6/1996 | Takimoto | 70/99 |

FOREIGN PATENT DOCUMENTS

| | | | |
|---|---|---|---|
| 23571 | 2/1883 | Germany | 292/39 |
| 805229 | 4/1951 | Germany . | |
| 536578 | 5/1941 | United Kingdom . | |
| 2168748 | 6/1986 | United Kingdom . | |
| 2212849 | 2/1988 | United Kingdom . | |

*Primary Examiner*—Steven Meyers
*Assistant Examiner*—John B. Walsh
*Attorney, Agent, or Firm*—Blakely Sokoloff Taylor & Zafman

[57] ABSTRACT

A lock for the locking of a sliding closure. The lock includes a housing (10) with a pair of hook shaped locking elements (11) which are mounted for counter-rotation within the housing. A handle (26) is mounted for rotation on the housing and is coupled to a gear wheel (23) which meshes with a pair of rack elements (30,32) which are located for sliding movement in the housing (10). A projection (34) from each rack element (30,32) engages in a curved slot (35) of the locking element (11). Consequently, rotation of the handle (26) results in a sliding movement of each of the racks (30,32) which causes the locking elements to move between a first position where the locking elements are substantially retracted in the housing (10) and a second position where the locking elements can latchingly engage with a strike.

16 Claims, 10 Drawing Sheets

LOCK FOR SLIDING DOOR

BACKGROUND OF THE INVENTION

1. Field of the Investigation

This invention relates to improvements in locks and more particularly to a lock suitable for the locking of a sliding closure such as a sliding door.

2. Background Information

Locks commonly used for latching-closed a sliding closure such as a sliding door have a lock beak which hooks into an opening in a latch plate or strike. Forced entry through the door is possible since the door usually can be lifted sufficiently to release the beak from the strike. To try and overcome this possibility, it is known to have a pair of locking beaks which lock in opposite directions and thereby resist any forced entry caused by lifting the door. However, it is still possible to apply force to the door in such a manner as to drive the beaks out of the locking position and thereby permit the door to be opened.

A problem which can also arise with locks for sliding doors is that the locking beak can be located in the locking position when the door is not in the fully closed and therefore lockable position. Thus, if the door is slammed shut with the beaks already in the locking position, damage to the beaks and/or lock mechanism can occur. Furthermore, damage to the strike can possibly also take place as the extended beak hits the strike.

BRIEF SUMMARY OF THE INVENTION

An object of the present invention is to provide a lock for locking a sliding door, the lock being more resistant to forced entry than previously known locks of this type.

According to one broad aspect of the invention there is provided a lock including a pair of hook shaped locking elements mounted for counter-rotation, means for controlled movement of the locking elements from a first position where the locking elements are substantially retracted in the housing and a second position where the locking elements can latchingly engage with a strike, the moving means including a handle accessible externally of the housing.

In the preferred form of the invention the moving means includes a gear wheel drivingly engaged with a pair of rack members, each rack member being drivingly coupled with a said locking element. According to the preferred form, each locking element is pivotally mounted relative to the housing and a drive element of one of the locking elements or the rack member is engaged with a follower of the rack member or the locking element as the case may be.

A further object of the present invention is to provide a lock for the locking of a sliding closure, the lock having an anti-slam protection mechanism which prevents the lock mechanism from being operated except when the closure is in a closed position.

According to a second broad aspect of the invention, there is provided a lock including a pair of hook-shaped locking elements mounted for counter-rotation, means for controlled movement of the locking elements from a first position where the locking elements are substantially retracted in the housing and a second position where the locking elements can latchingly engage with a strike, the moving means including a handle accessible externally of the housing, there being a means for preventing movement of the locking elements unless the lock housing is at a predetermined disposition to the strike.

In the preferred form, the prevention means includes a latching element which engages with the moving means to prevent actuation thereof, there being an actuator which as the lock housing approaches the strike causes the latching element to release the moving means.

In a preferred form of the invention at least one rack member is provided with a coupling means for coupling the rack member to a connecting rod from a shoot bolt.

The invention also can include a shoot bolt strike which comprises a mounting base and a shoot bolt strike plate adjustably mounted with the base.

In a preferred form of the invention the strike plate is movable relative to the mounting base against biasing means.

The connecting rod in one preferred form slidingly engages in a bore extending longitudinally through one leg of a substantially L-shaped guide; the other leg of the L-shaped guide being adapted for mounting to a part of a door at right angles to that part of the door along which the connecting rod extends.

The movement of the locking beaks 11, as described above, is achieved through a drive arrangement as hereinafter described.

Figure 3:
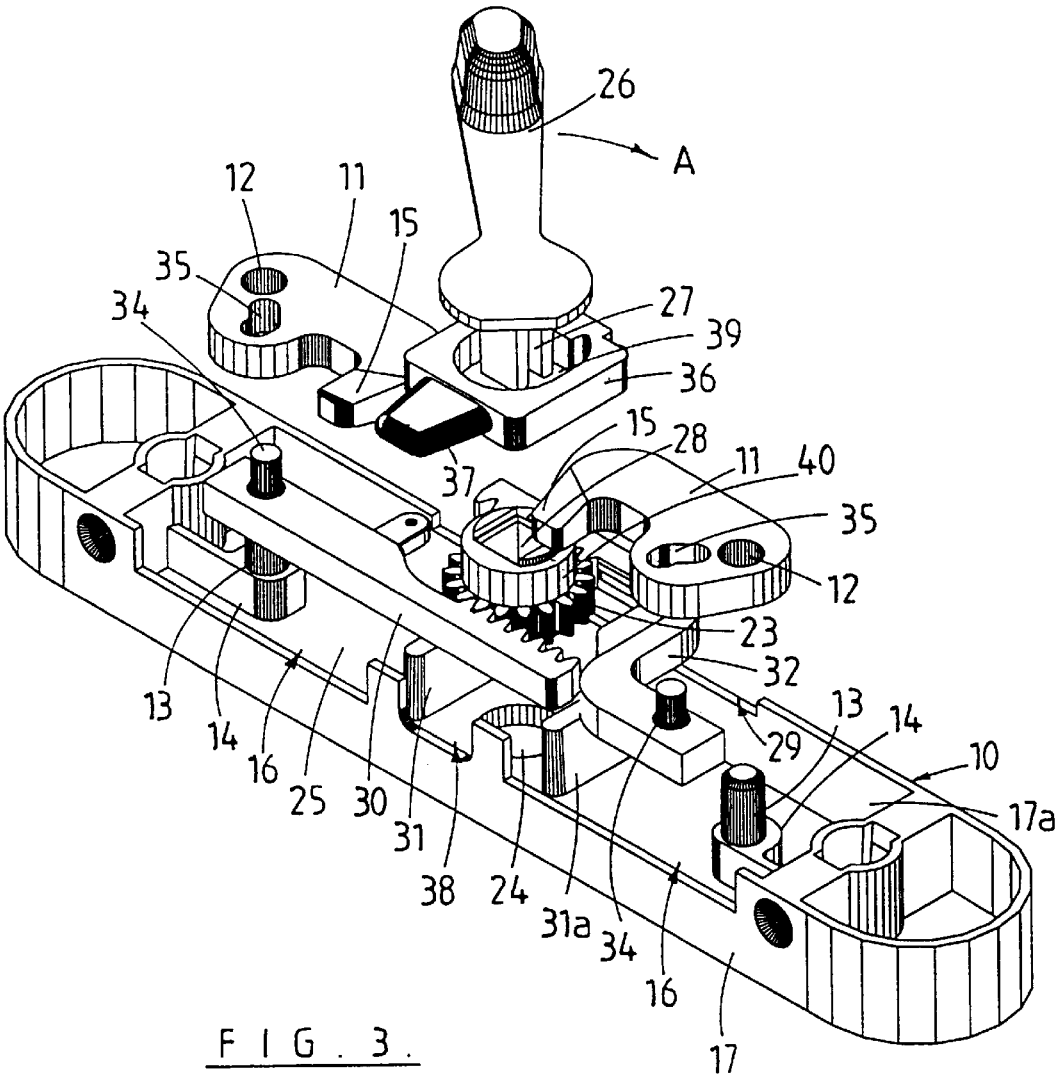
FIG. 3 is an exploded perspective view of the lock shown in FIG. 1.
Figure 10:
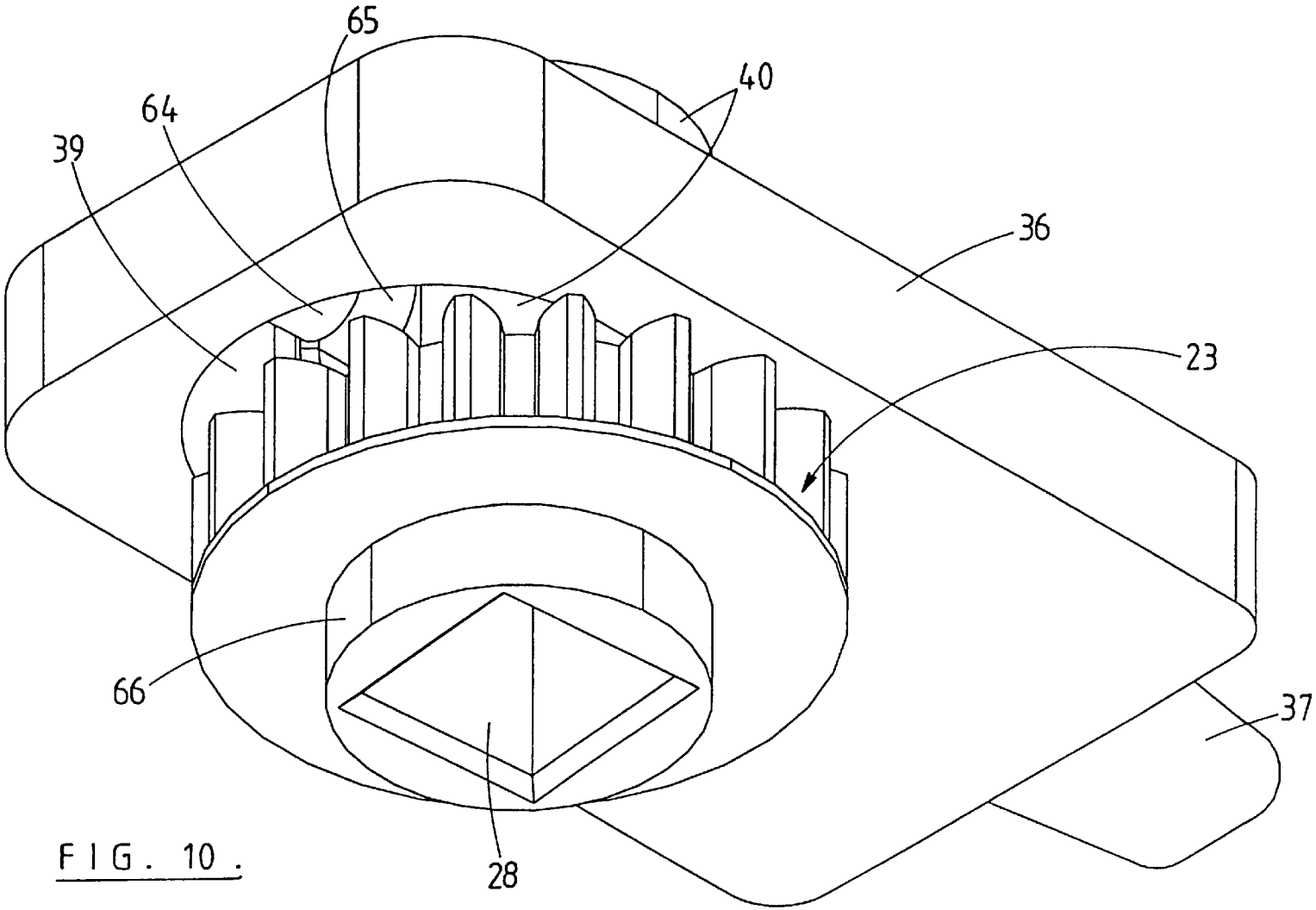
FIG. 10 is a perspective partial view of the lock illustrated in FIGS. 1, 3 and 5 showing the toothed gear wheel and anti-slam block.

As seen in FIG. 3, the drive arrangement consists of a toothed gear wheel 23. As seen in FIGS. 10 and 3, toothed gear wheel 23 is mounted by spigot portion 66 that rotatably locates wheel 23 in spigot opening 24 in floor 25 of housing 10. An operating handle 26 has a drive portion 27 which engages within a hollow interior part 28 of the gear wheel 23. Handle 26 extends through a slot 29 formed in the other wall 17*a* of housing 10. Thus, as handle 26 is moved in the direction of arrow A, the gear wheel 23 is caused to rotate.

A first toothed drive member 30 is slidingly engaged within housing 10 with the teeth thereof meshing with the teeth of toothed gear 23. Drive member 30 is slidingly engaged on floor 25 between wall 17 and mount 14.

A second toothed drive member 32 is similarly slidingly engaged in housing 10, the teeth of this drive member also engaging with the teeth of gear 23. Drive member 32 is cranked in its length so that one end slidingly engages between wall 17 and the other of mounts 14 while the opposite end slidingly engages between gear 23 and wall 17*a*.

The ends of each of drive members 30 and 32 which engage between wall 17 and the respective mounts 14 each carry a spigot 34. Spigot 34 engages in an elongate arcuate slot 35 in the respective ones of locking beaks 11.

Figure 1:
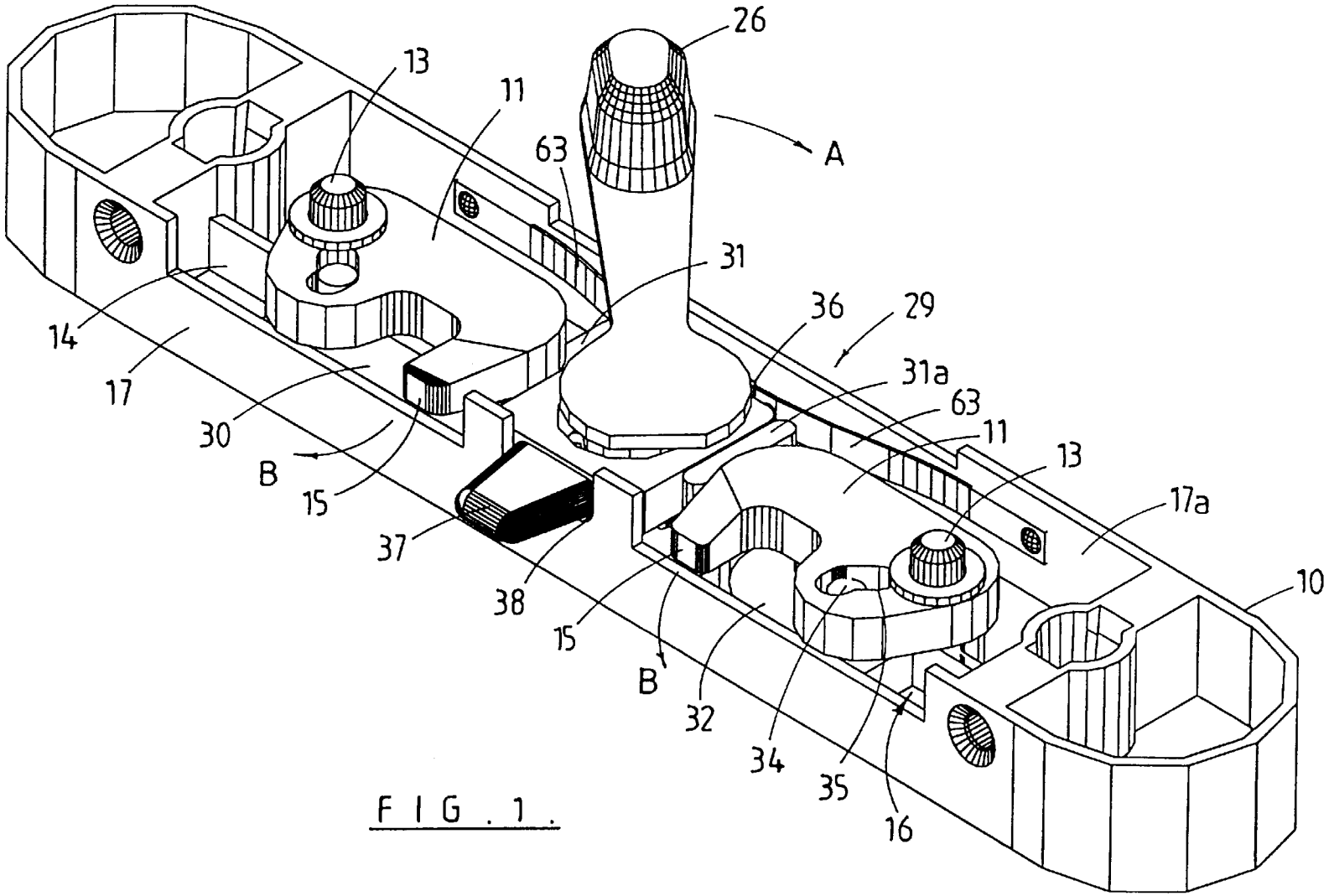
FIG. 1 is a perspective view of an assembled surface lock.

Accordingly, as handle 26 is moved in the direction of arrow A shown in FIGS. 1 and 3 the gear wheel 23 rotates. This causes the drive members 30 and 32 to move such that the spigots 34 move relatively apart. With slot 35 bent or curved such as in the form of a bow, the movement of spigots 34 along arcuate slots 35 in beaks 11 thus forces the locking beaks 11 to move about the pivot axis of pins 13. The beaks 11 thus counter-rotate so that the nibs 15 thereof move outwardly on an arc (see arrows B in FIG. 1) about the aforesaid pivot axis of pins 13 to project from housing 10 and engage in the openings 18 of strike 19 of FIG. 6.

Reverse movement of handle 26 of FIG. 3 causes the spigots 34 to move relatively toward one another thereby causing the nibs to be retracted as a consequence of pivotal movement of the locking beaks 11.

The construction of the lock is such that the locking beaks 11 move on a rotational arc of motion which is different to the line of movement of the racks 30 and 32. Consequently, even if force is applied to the door during attempted forced entry, the force which can be applied to the locking beaks in an effort to move the beaks on their rotational arc of motion cannot result in movement of the racks along their quite different lines of travel.

The lock incorporates an anti-slam mechanism which includes a block 36 of FIG. 3. Block 36 slidingly engages between parallel partitions 31 and 31*a*. A tongue 37 extends from block 367 through tongue opening 38 in side wall 17 of housing 10. The block 36 includes a centrally located aperture 39 in which turret 40 of toothed gear 23 rotatably engages. Block 36 is biased to the position shown in FIGS. 1 and 3 by a biasing means such as a leaf spring 63 (see FIG. 1).

Figure 2:
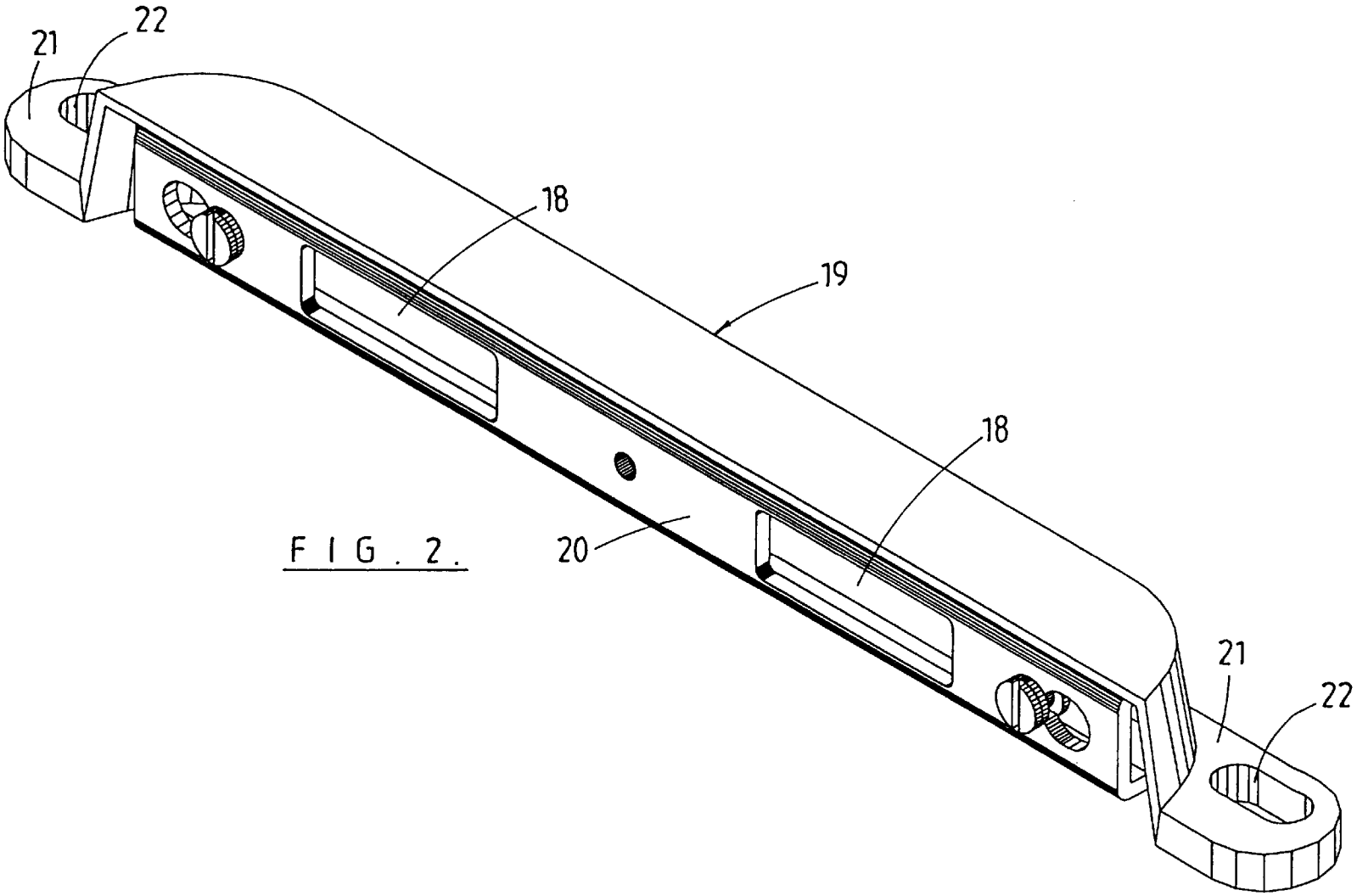
FIG. 2 is a perspective view of a strike for the surface lock of FIG. 1.

With the lock in the position shown in FIG. 1 where tongue 37 projects to its full extent through tongue opening 38, pin 64 of FIG. 10—fixedly mounted within the aperture 39 of block 36 —is urged by the force of leaf springs 63 to engage in an opening 65 in the turret 40 of toothed gear 23. This prevents gear 23 of FIG. 3 from rotating so as to prevent handle 26 from being moved. However, as the door moves to the closed position, tongue 37 of FIG. 1 engages with the striker plate 20 of FIG. 2 (between openings 18) such that continued closing movement of the door causes the anti-slam block 36 to slidingly move between and along partitions 31 and 31*a* to take up a position relative to turret 40 as shown in FIG. 10. To achieve this sliding movement, aperture 39 in block 36 of FIG. 10 is elongated in the direction of movement of the block 36. This movement releases the locking effect between opening 65 in gear 23 so that handle 26 of FIG. 1 can be moved to effect extension of the locking beaks 11 and thereby interengagement of same with striker 19.

Consequently, the anti-slam protection mechanism locks the drive gear from rotating and thus throws the beaks 11 except when the slam block 36 has been disengaged from the gear 23, such as occurs when the door is closed. The anti-slam protection mechanism thus prevents the lock mechanism from being operated except when the sliding door is closed. Thus, the lock beaks 11 should never be in a protruded state when the door is open. Hence, if the door is slammed shut the beaks and therefore the lock mechanism will not be damaged.

Figure 4:
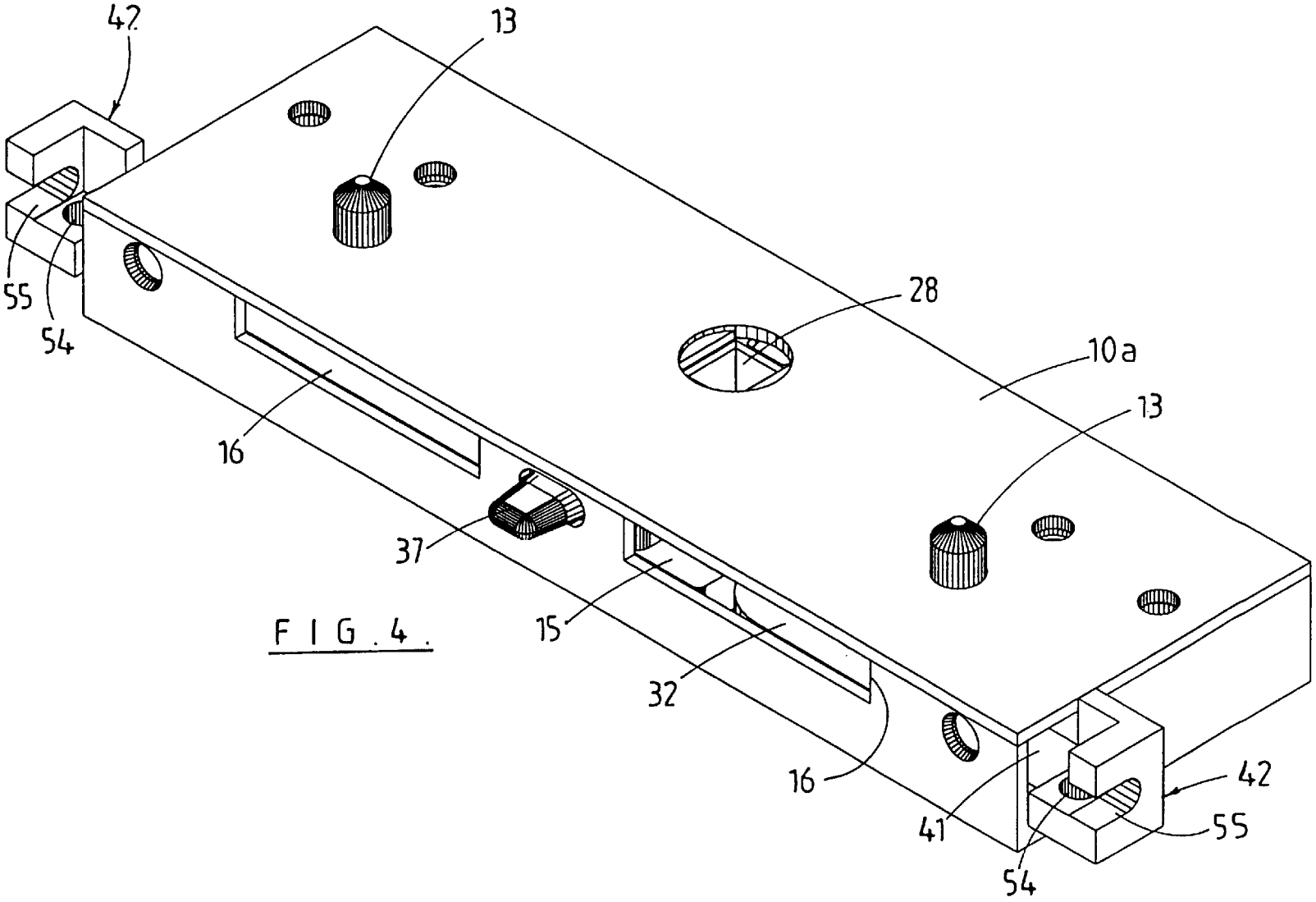
FIG. 4 is a perspective view of a mortise lock.
Figure 5:
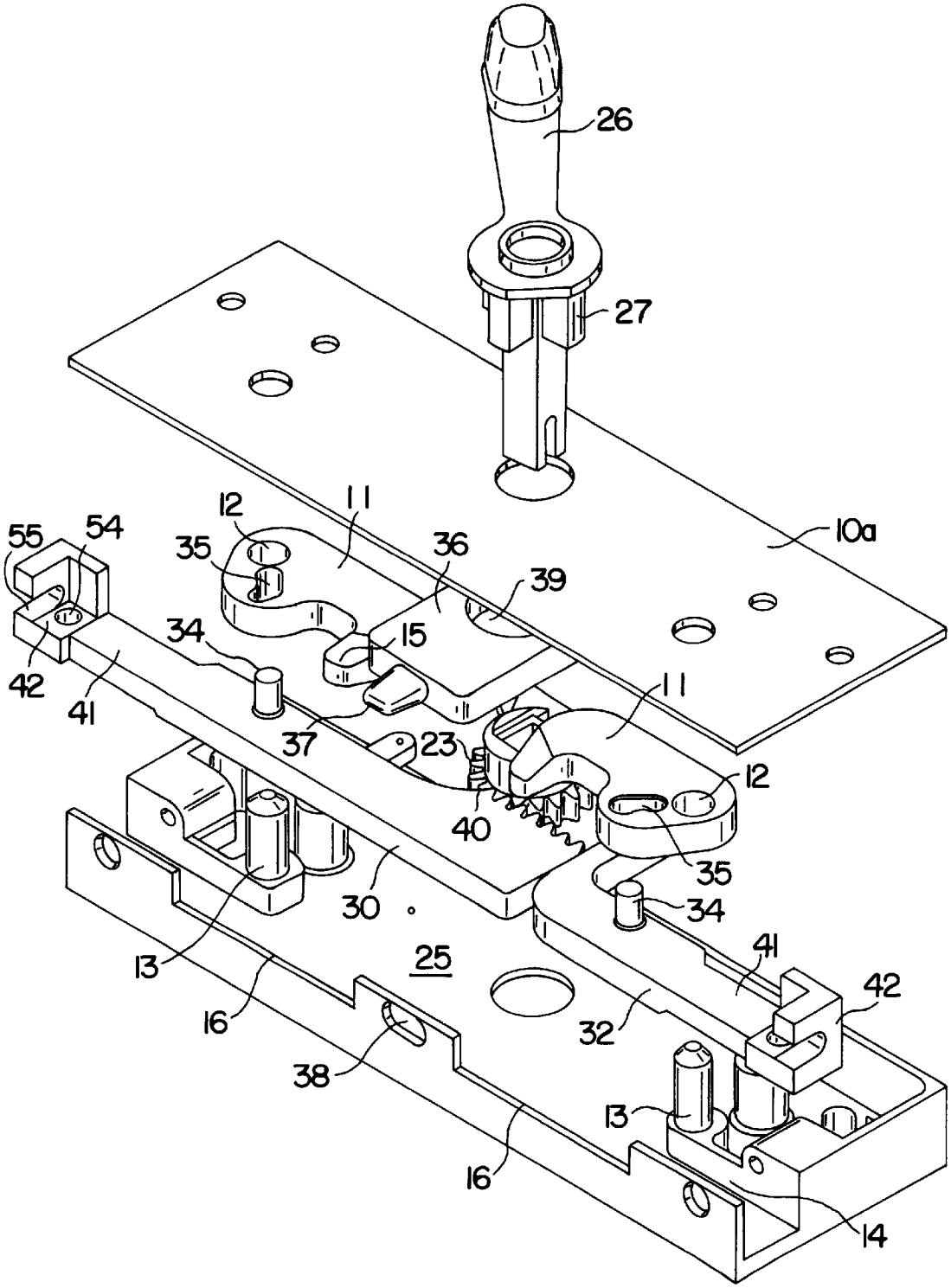
FIG. 5 is an exploded perspective view of the mortise lock shown in FIG. 4.
Figure 6:
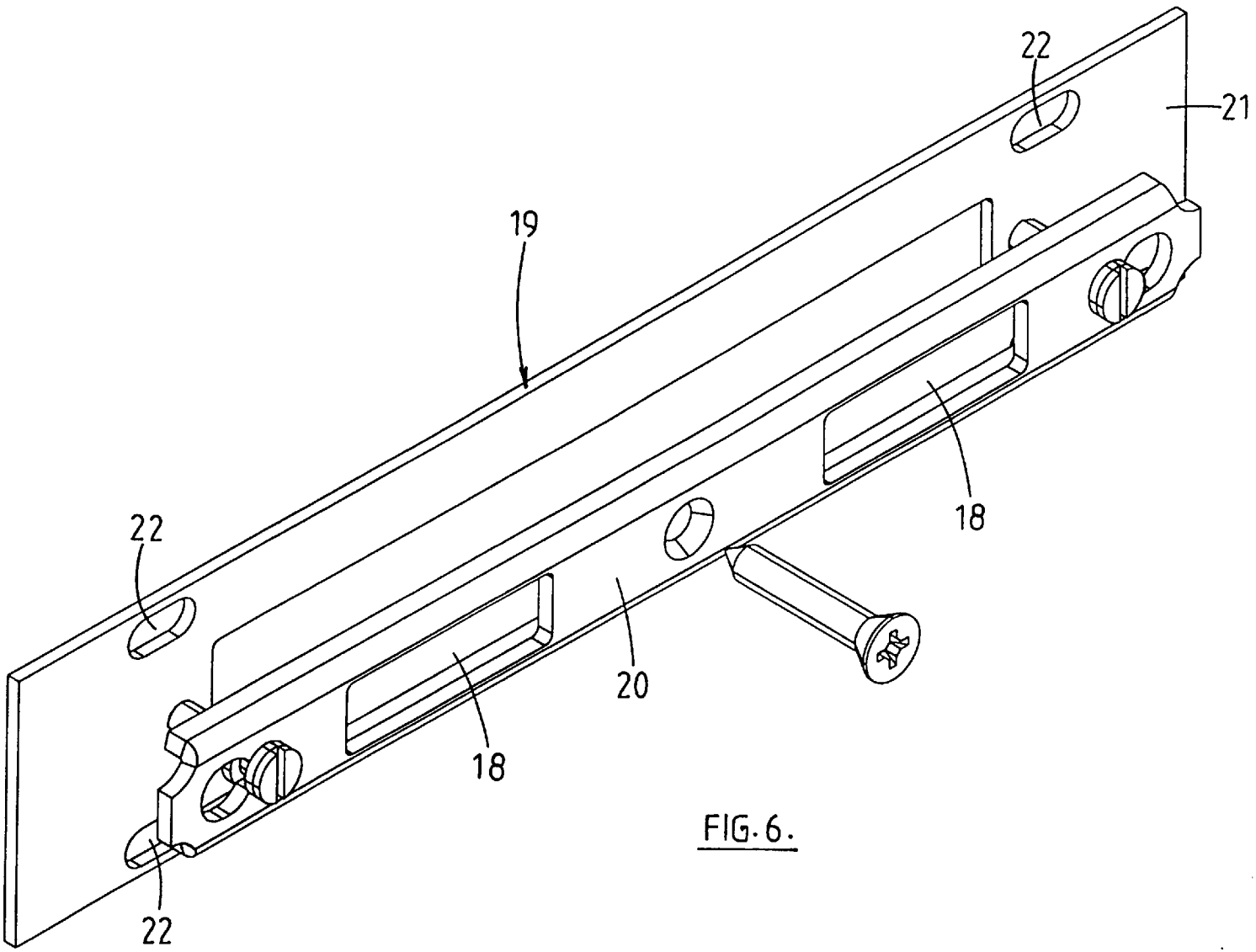
FIG. 6 is a perspective view of a strike for the mortise lock of FIGS. 4 and 5.
Figure 7:
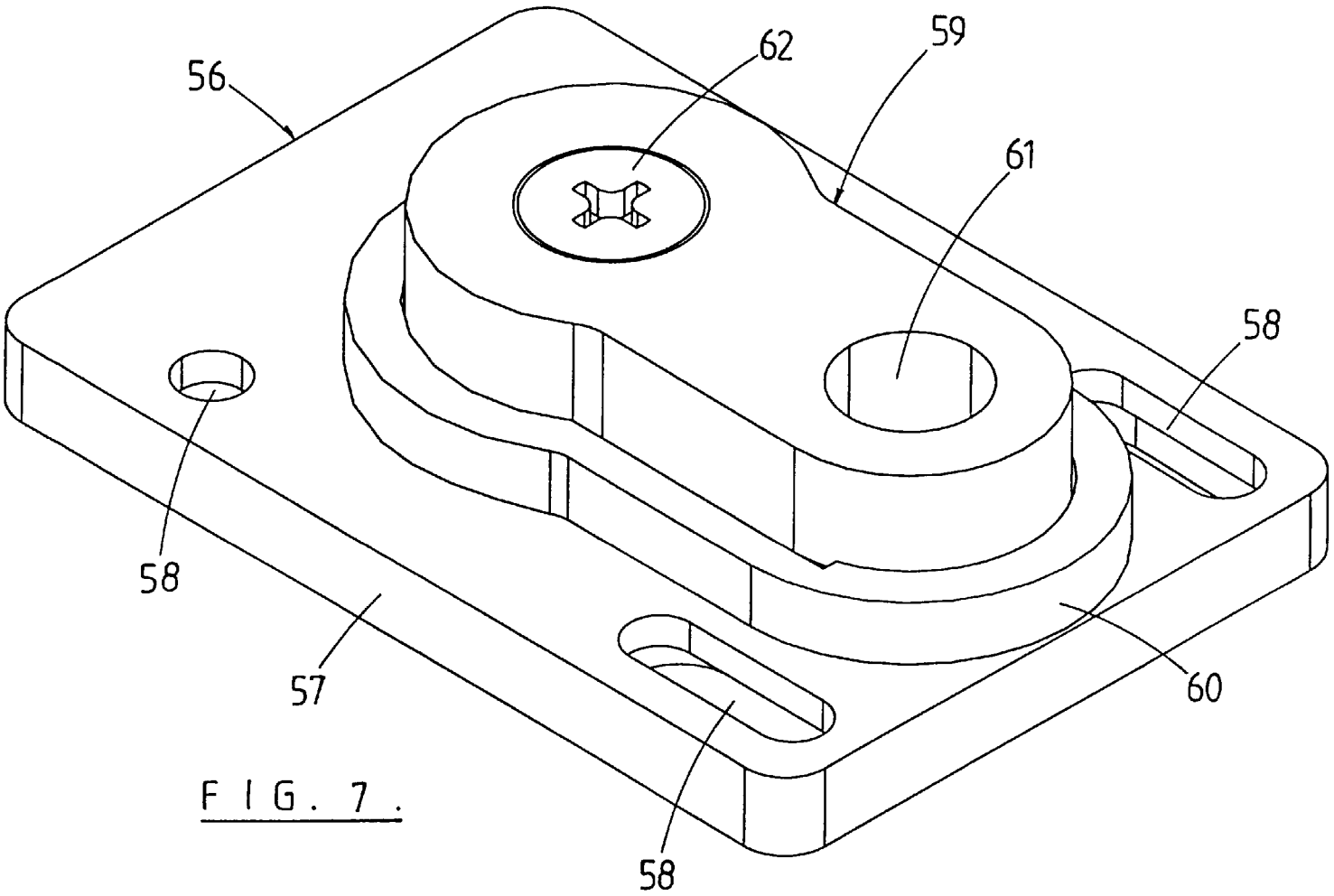
FIG. 7 is a perspective view of a strike assembly for use in conjunction with a shoot bolt incorporated with a lock of FIGS. 4 through 6.

In the mortise lock embodiment of the invention as shown in FIGS. 4, 5 and 6, the construction of the lock is essentially the same and thus the same reference numerals are used to identify the same elements. In the drawings, however, the cover 10*a* of housing 10 is illustrated.

In the mortise lock embodiment of the invention, the ends of the rack or drive members 30 and 32, having spigots 34, can incorporate extensions 41 with mountings 42. The ends of connecting rods 68 can be fixedly attached (not shown), these rods extending within the door (or more usually the framing of the door) to a shoot blot 43 (see FIGS. 8 and 9). Thus, as the lock moves to and from the locked position, the connecting rods 68 are moved due to their fixed end mounting with mounts 42.

Figure 8:
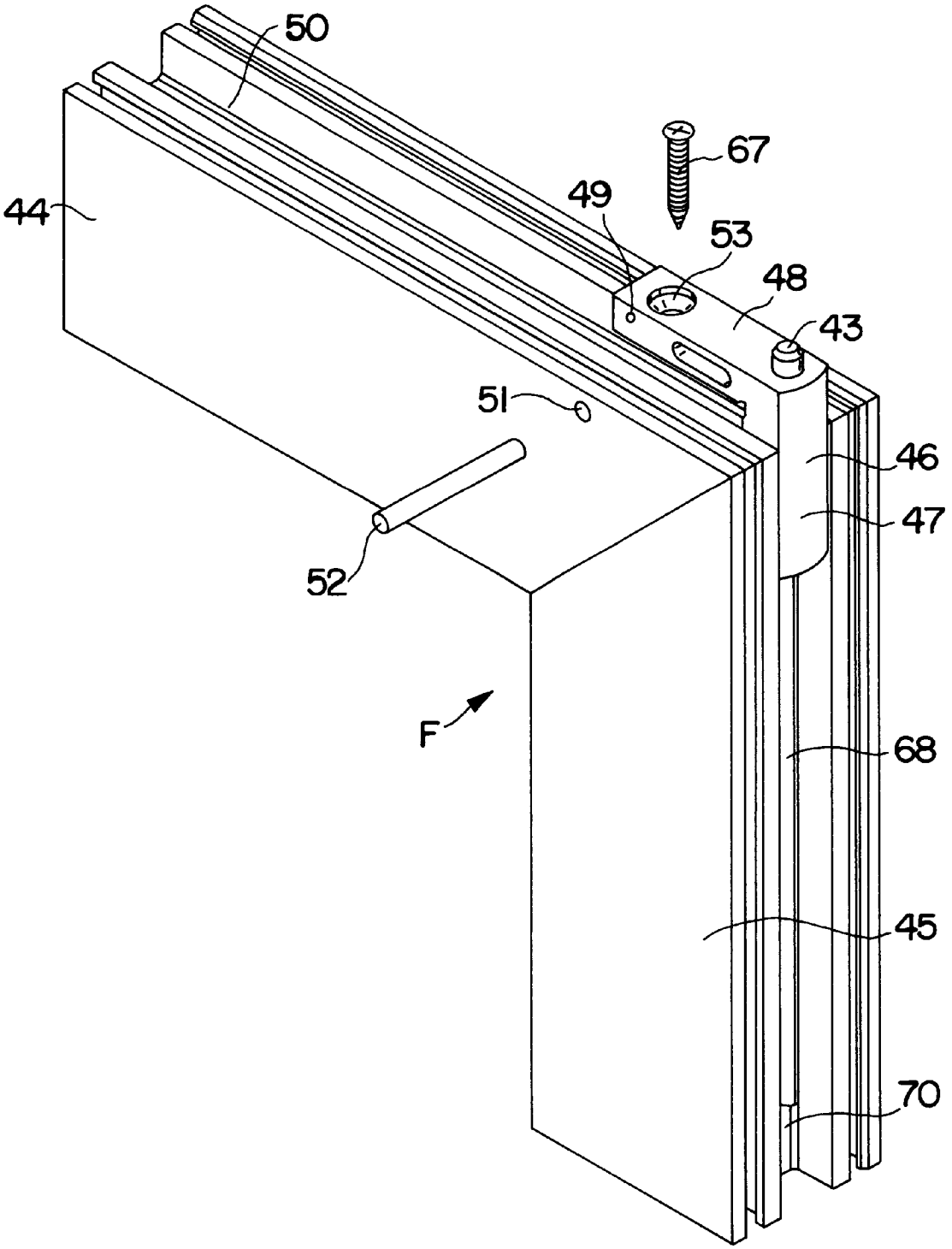
FIG. 8 is a perspective exploded view of a part of a door construction showing a shoot bolt guide.
Figure 9:
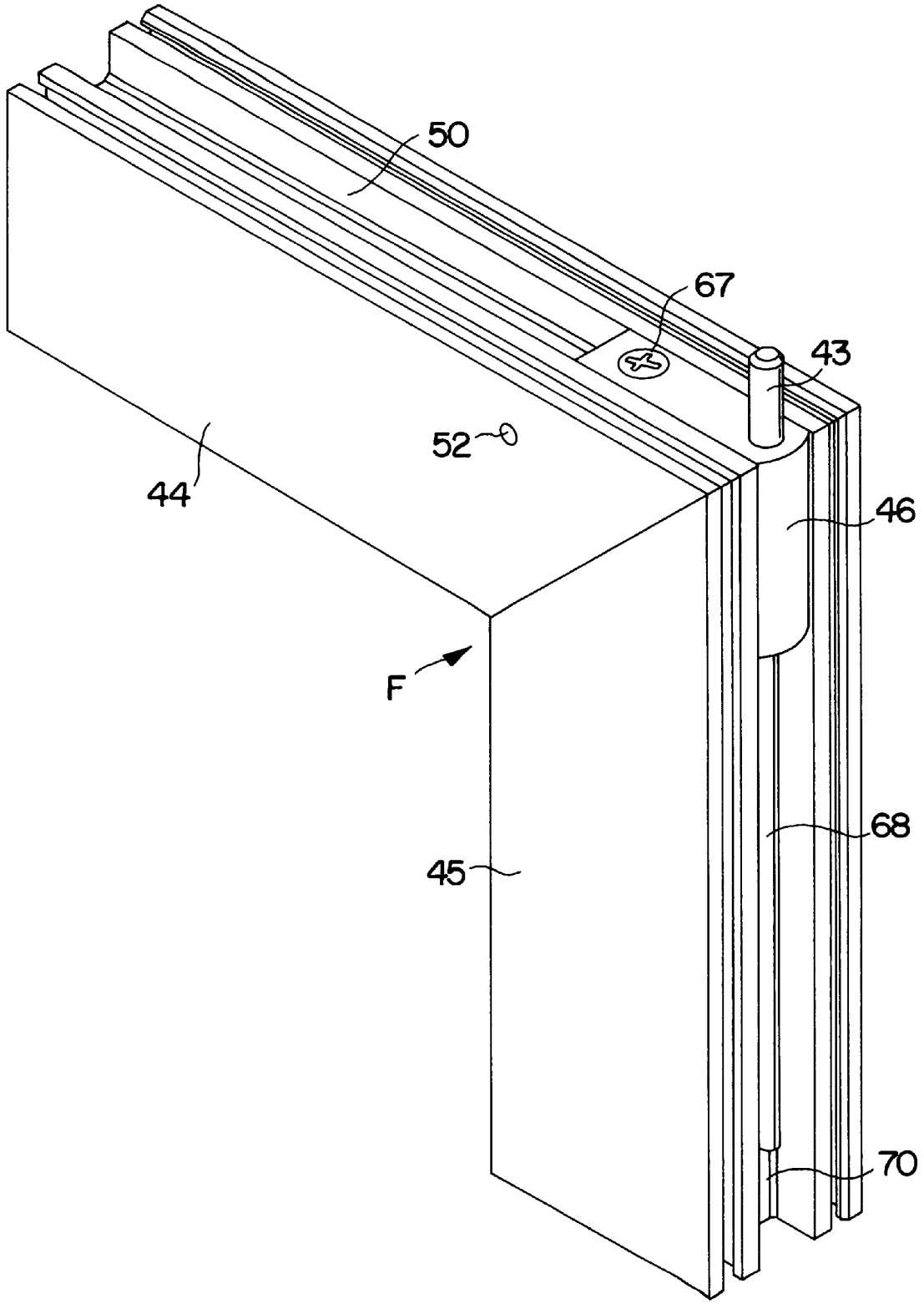
FIG. 9 is similar to FIG. 8 but in assembled form.

Referring now to FIG. 8 of the drawings, there is shown a part of the framing of a door, the framing being formed from a uPVC extrusion. The drawing shows part of the top extrusion 44 and a vertical lock mounting extrusion 45.

The shoot bolt 43 is attached (such as by crimping) to the end of the connecting rod 68. Connecting rod 68 extends, as described above, from the mounts 42 of first toothed drive member 30 and second toothed drive member 32 in the lock through rod guide 46 to shoot bolt 43.

In the illustrated arrangement of FIG. 8, rod guide 46 is generally L-shaped with one leg 47 having a bore therethrough in which the shoot bolt 43 and the part of the connecting rod 68 to which shoot bolt 43 is connected are slidingly engaged. The other leg 48 includes a transverse bore 49 which, when the leg 48 is located in groove 50 of top extrusion 44, aligns with a pair of openings 51 in the side walls of that part of the extrusion 44 forming groove 50. A securing pin 52 can thus be inserted through the aligned bore 49 and opening 51 to locate leg 48 in place within groove 50.

Also included in leg 48 is a countersunk aperture 53 which extends at right angles to bore 49 and at least the countersunk portion thereof intercepts with bore 49. Thus, with leg 48 in place in groove 50, countersunk fastening screw 67 can be inserted through aperture 53 to further fasten leg 48 in place. Due to the intersection of bore 49 with at least countersunk portion of aperture 53, the head of the fastening screw also captures the securing pin 52 in place.

Each connecting rod 68 has a small, ninety degree bend at the end to be coupled with the mount 42 of FIG. 5. During assembly, the ninety degree bent end is located in the securing hole 54 of mount 42 while the rod 68 is positioned perpendicular to their intended lie of movement. The rod 68 is then swung through ninety degrees so as to lie flat along the length of the vertical extrusion 45 of FIG. 8, for example to lie in groove 70 of vertical extrusion 45. The rod guides 46 are then secured in place as described above thereby resulting in the connecting rods being completely secured in position.

As the shoot bolt 43 is extended from rod guide 46 due to movement of connecting rod 68 (see FIG. 9), shoot bolt 43 comes into engagement with a strike 56, there being a strike mounted to both the head and sill of the door frame. The strike 56 comprises a base 57 having a plurality of openings 58 through which fixing screws can engage the door frame. A strike latch 59 is mounted within a wall 60 which projects from base 57. Strike latch 59 includes an opening 61 into which the free end of the shoot bolt 43 can engage when the lock is in the locked position.

In the preferred form of the invention, a biasing element (for example a spring) is located within the confines of wall 60 and acts between the floor of the strike base 57 and the opposing surface of strike latch 59. This biasing effect forces the strike latch 59 out of the recess formed by wall 60 though this is prevented from egress completion by a screw 62 which extends through the strike latch 59 to the strike base 57.

By having the strike latch 59 spring-loaded, damage to the door mechanism is prevented in the even that the shoot bolts 43 are thrown when not correctly aligned with the opening 61 in the strike 59. Furthermore, the amount by which the strike latch 59 projects from the wall 60 can be adjusted by adjustment of screw 62. This provides for a degree of height adjustment of the head and sill strikers 56, such adjustment being able to take place while the door is in the frame. This adjustment is contrary to other systems which rely on height adjustable shoot bolts, such adjustment usually being achieved by rotating the shoot bolt in a threaded boss on the lock assembly. As a consequence, adjustment can often only be carried out while the door is out of the frame.

As a consequence of the fixed mounting of the rod guide 46, the shoot bolt 43 is maintained in correct alignment. This reduces the possibility that, under load, the shoot bolt 43 can move about the point of attachment within rod guide 46. In turn, this minimizes the movement of shoot bolt 43 relative to the strike 56 so that it is unlikely that the shoot bolt 43 will pop out of the strike 56. In comparison to known systems, a rod guide can rotate about its point of connection under load. The effect of this rotational movement may reduce the vertical height of the shoot bolt so as to increase the ease with which the shoot bolt can be forced out of the strike.

With uPVC section doors, known guide systems tend to rely on the application of one or two screw fasteners extending into the unreinforced 2 mm thick uPVC section As uPVC under load suffers from creep, a loading applied to the door can result in movement of the rod guide to the extent that the shoot bolt can move from the strike. However, according to the securing method provided by the present invention, rod guide 46 is located within two of the vertical wall sections of the extrusions 44 and 45 such that creep is substantially reduced. Furthermore, the fastening of pin 52 by fastener 67 through aperture 53 causes rod guide 46 as well as pin 52 to be clamped firmly in position.

Furthermore, the present invention provides for rod guide 46 to be closely toleranced to shoot bolt 43 so that good contact is made between rod guide 46 and shoot bolt 43, thus creating a bearing situation. This, in effect, results in shoot bolt 43 acting purely in shear, thus enabling the use of much lighter gauge of connecting rod.

What is claimed is:

1. A lock comprising a housing;

a pair of hook shaped locking elements mounted for counter-rotation about spaced apart pivot axis within the housing, each locking element having a free end portion;

moving means for controlled movement of the locking elements from a first position where the locking elements are substantially retracted in the housing and a second position where the locking elements extend from the housing and the free end portions thereof can latchingly engage with a strike, said free end portions of the locking elements extending away from each other in opposite directions, the moving means including a gear wheel drivingly engaged with a pair of rack members, each rack member being drivingly coupled with one of said locking elements a handle accessible externally of the housing and mounted for movement about an axis of rotation, said axis of rotation being positioned substantially midway between the spaced apart pivot axis of the locking elements;

a latching element engaged with the moving means to prevent actuation unless the lock housing is at a predetermined disposition to the strike; and an actuator which as the lock housing approaches the strike causes the latching element to release the moving means.

2. A lock as claimed in claim 1 wherein the moving means includes at least one driving element which transfers drive from the handle to the locking elements, said driving element being moved rectilinearly by said handle.

3. A lock as claimed in claim 2 wherein a pair of said driving elements are provided, each having a coupling which slidingly engages in a curved guide provided with one of said locking elements.

4. A lock as claimed in claim 1 wherein each locking element is pivotally mounted relative to the housing and a drive element of one of the locking elements or the rack member is engaged with a follower of a respective one of the rack member and the locking element.

5. A lock as claimed in claim 4 wherein the drive element is a projection which slidingly engages in a curved slot in the locking element.

6. A lock including a housing, a pair of hook shaped locking elements mounted for counter-rotation within the housing, moving means for controlled movement of the locking elements from a first position where the locking elements are substantially retracted in the housing and a second position where the locking elements can latchingly engage with a strike, the moving means including a handle accessible externally of the housing and a gear wheel drivingly engaged with drive elements which impart a rotational movement to the respective locking elements upon rotational movement of the handle occurring, there being a latching element which engages with the moving means to prevent actuation thereof unless the lock housing is at a pre-determined disposition to the strike, and an actuator which as the lock housing approaches the strike causes the latching element to release the moving means.

7. A lock as claimed in claim 6 wherein the axes of rotation of the gear wheel and handle are substantially coincident, said gear wheel being coupled to said latching elements the lock further including locking means substantially preventing rotation of the gear wheel when the latching element is in a first position.

8. A lock as claimed in claim 7 wherein said latching element (36) is slidingly located in the housing, the latching element including an elongate cavity in which a turret of the gear wheel is rotatably engaged, there being locking means locking the turret against rotation until the latching element is slidingly moved to said second position such that the locking means is released to permit the turret and gear wheel to rotate.

9. A lock as claimed in claim 8 wherein the locking means is a projection carried by one of the latching element or turret and a recess with the respective other of the turret or latching element, said projection engaging with the recess to prevent rotation of the gear wheel until said latching element moves to the second position whereupon the projection releases from the recess.

10. A lock as claimed in claim 6 wherein at least one rack member is provided with a coupling means for coupling the rack member to a connecting rod from a shoot bolt.

11. A lock as claimed in claim 10 further including a shoot bolt strike which comprises a mounting base and a shoot bolt strike plate (59) adjustably mounted with the base.

12. A lock as claimed in claim 11 wherein the strike plate is movable relative to the mounting base against biasing means.

13. A lock as claimed in claim 10 wherein the connecting rod slidingly engages in a bore extending longitudinally through one leg of a substantially L-shaped guide, the other leg of the L-shaped guide being adapted for mounting to a part of a door at right angles to that part of the door along which the connecting rod extends.

14. A lock as claimed in claim 13 in combination with a door frame wherein said other leg of the L-shaped guide includes a bore aligned with openings in said door frame, there being a pin located through the aligned bore and openings.

15. The combination of claim 14 wherein said other leg includes a fastener opening through which a fastener is engaged into said door frame.

16. A lock as claimed in claim 12 wherein the strike plate is located within a wall, there being adjusting means for adjusting the amount by which the strike plate projects from the wall.

* * * * *

UNITED STATES PATENT AND TRADEMARK OFFICE

CERTIFICATE OF CORRECTION

PATENT NO. : 5,951,068

DATED : September 14, 1999

INVENTOR(S) : Strong et al.

It is certified that error appears in the above-identified patent and that said Letters Patent is hereby corrected as shown below:

In column 5, line 2, delete "in the even" and insert -- in the event -- .

In column 5, line 27, delete "uPVC section" and insert -- uPVC section. -- .

In column 5, line 44, delete "A lock comprising" and insert -- A lock comprising: -- .

Signed and Sealed this

Seventeenth Day of April, 2001

*Attest:*

Nicholas P. Godici

NICHOLAS P. GODICI

*Attesting Officer*

*Acting Director of the United States Patent and Trademark Office*